US007144850B2

(12) United States Patent
Galick et al.

(10) Patent No.: US 7,144,850 B2
(45) Date of Patent: Dec. 5, 2006

(54) DRYCLEANING METHOD USING DIPROPYLENE GLYCOL DIMETHYL ETHER

(75) Inventors: Paul E. Galick, West Chester, PA (US); David R. Kinney, The Woodlands, TX (US); Ellen S. Lenz, West Chester, PA (US); Larry W. Arndt, West Chester, PA (US)

(73) Assignee: Lyondell Chemical Technology, L.P., Greenville, DE (US)

( * ) Notice: Subject to any disclaimer, the term of this patent is extended or adjusted under 35 U.S.C. 154(b) by 55 days.

(21) Appl. No.: 10/926,372

(22) Filed: Aug. 25, 2004

(65) Prior Publication Data

US 2006/0042021 A1 Mar. 2, 2006

(51) Int. Cl.

| | |
|---|---|
| ***C11D 3/00*** | (2006.01) |
| ***D06L 1/02*** | (2006.01) |
| ***D06L 1/04*** | (2006.01) |

(52) U.S. Cl. ..... 510/285; 510/287; 510/516; 8/142

(58) Field of Classification Search ..... 8/142; 510/285, 287, 516

See application file for complete search history.

(56) References Cited

U.S. PATENT DOCUMENTS

| | | | | |
|---|---|---|---|---|
| 5,888,250 | A | 3/1999 | Hayday et al. | 8/142 |
| 6,042,617 | A | 3/2000 | Berndt | 8/142 |
| 6,086,634 | A | 7/2000 | Smith | 8/142 |
| 6,156,074 | A | 12/2000 | Hayday et al. | 8/142 |
| 6,172,031 | B1 | 1/2001 | Stevens | 510/417 |
| 6,273,919 | B1 | 8/2001 | Hayday | 8/142 |
| 6,350,287 | B1 | 2/2002 | Hayday | 8/142 |
| 6,455,479 | B1 | 9/2002 | Sahbari | 510/175 |
| 6,541,536 | B1 | 4/2003 | Weikard et al. | 522/84 |
| 6,696,399 | B1 | 2/2004 | Chernin et al. | 510/241 |
| 6,749,643 | B1 | 6/2004 | Sugo et al. | 8/142 |
| 6,818,021 | B1 * | 11/2004 | Noyes et al. | 8/142 |
| 6,828,292 | B1 * | 12/2004 | Noyes et al. | 510/287 |

FOREIGN PATENT DOCUMENTS

| | | |
|---|---|---|
| WO | WO 01/16422 | 3/2001 |

* cited by examiner

*Primary Examiner*—Douglas McGinty
*Assistant Examiner*—Preeti Kumar
(74) *Attorney, Agent, or Firm*—Jonathan L. Schuchardt; John Calve

(57) ABSTRACT

A drycleaning method is disclosed. In the method, a composition that comprises at least about 85 wt. % dipropylene glycol dimethyl ether (DMM) is used. The limited solubility of water in DMM is ideal for drycleaning. The method provides good stain removal and fast drying while avoiding excessive fabric shrinkage or soil redeposition.

14 Claims, No Drawings

DRYCLEANING METHOD USING DIPROPYLENE GLYCOL DIMETHYL ETHER

FIELD OF THE INVENTION

The invention relates to a method for drycleaning fabrics and fibers. In particular, the invention is a drycleaning method that uses a composition containing dipropylene glycol dimethyl ether.

BACKGROUND OF THE INVENTION

Conventional methods for drycleaning use a chlorinated hydrocarbon solvent, most commonly perchloroethylene (PERC) in combination with small amounts of water and detergents. While PERC is fabric-safe, non-flammable, and easily recycled, it has come under attack in recent years as an environmental and health hazard. In particular, PERC is listed as a Hazardous Air Pollutant (HAP), it is non-biodegradable, and it is a probable human carcinogen.

In recent years, the industry has responded with less-toxic alternatives to PERC, including hydrocarbons (e.g., Eco-Solv™ drycleaning fluid from CPChem) and glycol ethers. We recently found (see copending application Ser. No. 10/653,725) that compositions that contain at least 80 wt. % dipropylene glycol n-propyl ether (DPnP) and up to about 15 wt. % water are exceptionally useful for drycleaning. Moreover, we found that there is no need to use DPnP in combination with polysulfonic acids or cyclic siloxanes as is taught elsewhere (see, e.g., U.S. Pat. Nos. 6,086,634 and 6,042,617).

Other glycol ethers have been recommended for use in drycleaning, most notably propylene glycol tert-butyl ether (PTB), propylene glycol n-butyl ether (PNB), dipropylene glycol tert-butyl ether (DPTB) and dipropylene glycol n-butyl ether (DPNB). See, for example, U.S. Pat. Nos. 5,888,250, 6,156,074, 6,273,919, and 6,350,287, all assigned to Rynex Holdings, Ltd. In particular, the '919 and '287 patents teach DPTB as an alternative with significant advantages over PERC. DPTB has a high flash point and good detergency. The compositions taught for use are DPTB/water (>9:1 by weight) mixtures. The use of glycol ethers, including DPTB, represents a significant step toward replacing PERC in drycleaning.

The ability of the solvent to solubilize enough water is another concern. Ideally, the solvent will have the ability to solubilize at least about 4 wt. % of water. There is a balance to strike, however, because a solvent holding too much water can promote more than a desirable amount of shrinkage.

With both alkyl ether and hydroxy end groups, glycol ethers such as DPTB and DPNB are amphiphilic. Consequently, they can be challenging to separate quickly and completely from a relatively small proportion of water. For example, water-saturated DPTB contains about 10 wt. % of water. An ideal drycleaning solvent will hold only about 5 wt. % of water when saturated. Moreover, an ideal solvent will separate rapidly and completely from the water extracted from fabrics during drycleaning.

Another drawback of some glycol ethers, particularly ones based on di- or tripropylene glycols, is their slow evaporation rate. For example, DPTB evaporates only 1.2% as fast as n-butyl acetate. Faster evaporation means higher productivity and profitability for a drycleaning business. Moreover, higher boiling glycol ethers are more costly to reclaim by distillation.

Some glycol ethers proposed for drycleaning have an undesirably low flash point, i.e., one that is near or below room temperature on a hot day. For example, PTB has a flash point (Tag, closed cup) of only 45° C. A minimum flash point of about 60° C. or higher would be preferable.

Dipropylene glycol dimethyl ether (DMM) is commercially available. It has been used in detergents (see, e.g., U.S. Pat. No. 6,696,399), polyurethane dispersions (U.S. Pat. No. 6,541,536), and polymer stripping compositions (U.S. Pat. No. 6,455,479). DMM has not been specifically mentioned as being useful for drycleaning.

Good progress has been made to date, but the industry continues to need replacements for PERC. In particular, the industry would benefit a drycleaning composition having a relatively high evaporation rate combined with an acceptable flash point. An improved drycleaning method would be effective for both oily and more water-soluble soils. An ideal cleaner would use readily available, inexpensive components, would rival or outperform PERC and its commercial alternatives, and would have a favorable water solubility profile. Finally, the drycleaning method must not harm the fabric. In particular, the method must not cause undue shrinkage (i.e., more than about 2%).

SUMMARY OF THE INVENTION

The invention is a method for drycleaning a fabric or fiber. The method comprises using a composition comprising at least about 85 wt. % of dipropylene glycol dimethyl ether (DMM). The composition can contain up to about 10 wt. % of water without promoting undue shrinkage.

We surprisingly found that DMM can be used in drycleaning with good results. The method has improved effectiveness compared with PERC and rivals or betters its commercial replacements for removing oily and water-soluble soils. The limited solubility of water in DMM makes it ideal for drycleaning. Additionally, DMM evaporates faster than most currently used PERC replacement solvents (hydrocarbons, glycol ethers), which enables dry cleaners to be more productive. In sum, the method offers good cleaning power while providing a fast-drying, fabric-safe, environmentally acceptable alternative to PERC.

DETAILED DESCRIPTION OF THE INVENTION

The method of the invention is used for drycleaning fabrics. Suitable fabrics include any textile articles that benefit from the drycleaning process. They include products made from a wide variety of natural and synthetic fibers, including, e.g., cotton, wool, silk, rayon, polyester, nylon, acetates, polyolefins, acrylics, spandex, and the like, and blends of these. Suitable fabric uses include garments and accessories, bedding, furniture coverings, rugs, wall coverings, draperies, napkins, tablecloths, and so on. The method can also be used to dryclean fibers, including wool fiber, before it is used to make a fabric.

The method of the invention uses dipropylene glycol dimethyl ether (DMM) as a solvent. DMM is normally produced as a mixture of isomers that may have head-to-head or head-to-tail configuration of the oxypropylene groups. The dimethyl ether functionality affords ideal water solubility. All of the DMM isomers have molecular formula $C_8H_{18}O_3$. Minor amounts of other compounds generated as by-products in the manufacture of DMM may also be present. DMM is commercially available as Proglyde® DMM from the Dow Chemical Company.

Compositions useful in practicing the method of the invention have at least about 85 wt. % of DMM. More preferably, the compositions have at least about 90 wt. %, and most preferably at least about 95 wt. % of DMM.

The compositions can contain up to about 10 wt. % water. Water helps to dissolve many soils, particularly those with substantial water solubility such as blood or tea. Too much water in the drycleaning formulation should be avoided, however, because it will cause many fabrics (e.g., cotton or wool) to shrink. Thus, preferred compositions have up to about 5 wt. % water. See, for example, the results in Table 2 below. Shrinkage values greater than about 2% are generally undesirable.

Optionally, the compositions contain additional components commonly used in the drycleaning industry. For example, the compositions can include other organic solvents, such as other glycol ethers, glycol esters, glycol ether esters, alcohols (especially $C_8$–$C_{12}$ aliphatic alcohols), hydrocarbons, or the like, and mixtures thereof. The compositions can also contain detergents, anti-static agents, surfactants, fabric softeners, brighteners, disinfectants, anti-redeposition agents, fragrances, and the like. For some examples of conventional additives, see U.S. Pat. No. 6,086,634, the teachings of which are incorporated herein by reference.

A variety of well-known drycleaning techniques can be employed. In a typical commercial process, garments are rotated in a tumble-type s washer that contains a drycleaning solvent, detergents, and other additives. Cleaning composition is drained from the tumbler, and the garments are spun to remove most of the liquid. The garments are then tumbled in heated air in a dryer to remove remaining traces of cleaning fluid. The cleaning composition is reused after purifying it by adsorption, distillation, or a combination of these methods. The method of the invention is also expected to have value for home drycleaning applications.

Cleaning power is crucial to the industry, and DMM effectively removes a wide spectrum of common stain types. Preliminary results, reported in Table 1 below, suggested that DMM/water (96:4) mixtures have considerable stain-removing capability. A later investigation, summarized in Table 3, provides more comprehensive results. In terms of composite stain index, measured and calculated as described below, a DMM/water (96:4) mixture was about average compared with other tested cleaners. The superior APHA color removal number in Table 1 probably reflects DMM's excellent performance in removing two highly colored materials, oil and red dye/animal fat.

In particular, the DMM/water mixture ranked first or second for six of fifteen tested stains, and was the best at removing butter, clay, red dye/animal fat, and curry. The performance on oil is particularly noteworthy because only PERC outperformed DMM. Moreover, water outperformed the field for six of the stains (tea, spaghetti sauce, blood, dessert, peat, and red wine), and DMM performed about as well as any other cleaner in removing peat or red wine. Because water can only be tolerated to a limited degree in drycleaning (usually 10% or less), the DMM/water (96:4) mixture is a favorable choice.

Table 4 shows the aggregate improvement due to using DMM. DMM outperformed PERC and EcoSolv DCF by 15–20%, but was actually 20–40% less effective than the DPTB-based Rynex solvents tested. Although it fell somewhat short of the DPTB-based solvents in stain removal, DMM's faster evaporation rate and favorable water solubility profile compared with DPTB provide offsetting benefits.

Importantly, DMM does not promote shrinkage. As the results in Table 2 demonstrate, greater shrinkage results from exposure of the fabric to increasing amounts of water. However, a DMM/water (96:4) mixture still gave an acceptable shrinkage of <2% with a worsted flannel fabric.

The method demonstrates good detergency properties. DMM provides improved effectiveness compared with PERC not only in terms of stain removal power, but also in terms of soil redeposition. As the whiteness index (WI) numbers in Table 3 indicate, PERC had the lowest overall WI value (64.4), which is a reflection of PERC's tendency to remove very oily soils (e.g., engine oil) and then, in the absence of a detergent, allow them to redeposit on the fabric. The DMM/water (96:4) mixture showed a higher WI of 82.8.

As Table 5 shows, our measurements indicate that DMM evaporates about 11% as fast as n-butyl acetate but nine times faster than Rynex cleaner and five times faster than EcoSolv DCF. A fast-evaporating solvent allows drycleaners to be more productive by reducing cycle time; they need not wait as long for garments and other articles to dry after cleaning. Moreover, less energy is needed to recover DMM because of its relatively low boiling point of 175° C. at 760 mm Hg. Although DMM is low-boiling, it has an acceptable flash point of 65° C. (SETA, closed cup), which is well above ambient temperatures on even the hottest days.

Water is soluble in DMM to a limited degree compared with its solubility in glycol ethers such as DPTB (see Table 6). This may be the result of DMM's diether functionality (and/or lack of hydroxyl functionality). As the results indicate, the hydrocarbon-based cleaner, EcoSolv DCF, is practically insoluble in water and will hold only about 100 ppm of water. In contrast, the glycol ether held about 10 wt. % of water. A balance is desirable here. The cleaner should be able to dissolve enough water to allow detergents, surfactants, and other additives used in drycleaning to be effective. Conversely, a limited amount of water in the solvent is desirable to minimize shrinkage. At a maximum of about 4.5 wt %, water solubility in DMM is ideal.

A drycleaning solvent should separate readily from small proportions of aqueous contaminants. A simple way to test how easily the solvent will separate from water is to combine them 1:1 by volume, shake, and allow them to separate. Ideally, the separation is fast and complete. As Table 7 shows, DMM forms two distinct layers faster than DPTB. It does not separate as quickly as EcoSolv DCF, which is not surprising. Interestingly, however, the initial separation quality of DMM-water mixtures is superior even to EcoSolv DCF, suggesting that it will be easy to quickly separate DMM from small amounts of aqueous contaminants and recycle it to the drycleaning operation.

The invention uses readily available, inexpensive components. As the results demonstrate, no cyclic siloxanes, polysulfonic acids, or other additives need to be used with DMM to achieve excellent drycleaning results. In sum, the method offers good cleaning power for a variety of common stain types while providing a fast-evaporating, fabric-safe, environmentally acceptable alternative to PERC.

The following examples merely illustrate the invention. Those skilled in the art will recognize many variations that are within the spirit of the invention and scope of the claims.

Test Methods

A. Stain/Soil Cleaning Method

A standard undyed cotton cloth having fifteen different stains (EMPA multistain, supplied by Testfabrics, Inc.) is stapled to a 22×22-cm stainless-steel screen. The mounted cloth is placed inside a one-gallon container, and the cleaning fluid of interest (600 g) is added. The container is sealed, placed on a mechanical roller, and rotated for 10 minutes at a roller speed of 30 revolutions per minute (rpm). As the container rotates, the cleaner drains through the cloth and removes the stains. The fabric is allowed to drain and is then dried overnight at room temperature. The APHA color of the cleaner solution is measured using a Hunter calorimeter or its equivalent. Total color removal results appear in Table 1.

B. Shrinkage Test Method

A square pattern (19×19 cm) is drawn on a worsted flannel cloth (neutral; oil content<0.5 wt. %; available from Testfabrics, Inc.). The dimensions of the marks in both the warp (length of fabric) and weft (width of fabric) directions are measured. The cloth is then immersed in 600 g of cleaner and rolled for 10 minutes at 30 rpm (without attaching the cloth to a steel screen). The cloth is then removed from the liquid, excess cleaner is allowed to drain, and the damp cloth is oven dried at 120° F. for 30 minutes, then allowed to dry overnight at room temperature. The dimensional change of the square pattern is then determined by measuring the pattern length in both warp and weft directions. In each case, the percent dimensional change=[(A−B)/A]×100, where A is the original dimension, and B is the dimension after cleaning. Results of shrinkage testing appear in Table 2.

C. Stain Index Method

In addition to measuring the APHA color of the cleaner solutions, we also analyzed each of the individual stains on the treated cloth samples using a HunterQuest II calorimeter and the following parameters: Color scale: CIE L*a*b*. Illuminant: D65 (simulates noon sunlight). Observer angle: 10 degrees. All measurements were performed in Reflectance-Specular Included mode.

Whiteness index (WI) is given by:

$$WI=0.01\times L^*(L^*-5.7b^*)$$

where 100=MgO white, and 0=black.

Stain index (SI) is given by:

$$SI=[100-L^*]+[abs(a^*)+abs(b^*)]$$

where 0=MgO white, 160=saturated red-orange.

The lowest SI values (indicating optimum stain removal) will be observed when color saturation is lowest (i.e., when the absolute values of a* and b* approach 0) and when whiteness index is highest (L* approaches 100). On the L*,a*,b* color solid scale used by HunterLab (Reston, Va.), the L* axis represents light and dark with L*=100 for white and 0 for black. On the a* axis, a positive value represents red coloring and a negative value represents green. The greater the absolute value, the greater the color saturation. On the b* axis, a positive value represents yellow and a negative value represents blue.

The SI value can approach 0 at its lowest. Theoretically, the Si value can be as high as 160 (a saturated red-orange color), because the highest values for L*, abs(a*), and abs(b*) are 60, 60, and 40 respectively. As a practical matter, however, the highest observed values will approach 100 because the human eye typically cannot detect colors at the highest color saturation levels.

Test samples are placed on telescope rings to flatten the fabric. A white tile is placed behind the cloth during measurements to ensure consistent results. After an initial measurement, the cloth is rotated 90 degrees and a second measurement is made. The results are averaged to report a single number for L*, a*, or b* (see Tables A–C). This technique reduces any direction-dependent texture effects from the fabric. The values obtained for L*, a*, and b* are used to calculate stain index (SI) and whiteness index (WI) by ASTM E313 as described earlier.

Sample Calculations

1. Whiteness index for DMM/water (96:4) using measured values for "No Stain" for L* and b* from Tables A and C:

$$WI=0.01\times L^*(L^*-5.7b^*)$$

$$WI=0.01\times 93.7[93.7-(5.7)(0.94)]$$

$$WI=0.01\times 93.7\times 88.34=82.8$$

2. Stain index for DMM/water (96:4), oil stain, using measured values for L*, a*, and b* from Tables A, B, and C:

$$SI=[100-L^*]+[abs(a^*)+abs(b^*)]$$

$$SI=[100-73.5]+[abs(1.74)+abs(5.33)]$$

$$SI=26.5+7.0=33.5$$

3. Average stain index for DMM/water (96:4) using SI values from Table 3:

$$\text{Ave } SI=[\text{sum of all } SI \text{ values measured}]/15 \text{ stains}$$

$$\text{Ave } SI=[33.5+8.9+33.8 \ldots +71.7]/15=635.9/15=42.4$$

4. Percent improvement from DMM/water (96:4):

$$\%\text{ improvement in average stain index due to } DMM=100\times abs[(SI_{control}-SI_{comp})-(SI_{control}-SI_{DMM})]/(SI_{control}-SI_{comp})$$

where the SI values are average stain indices for DMM/water 96:4 (42.4), the control (48.9), and the comparative solvents.

Simplifying:

$$\%\text{ improvement}=abs[(SI_{DMM}-SI_{comp})]/(SI_{control}-SI_{comp})\times 100$$

For DMM/water (96:4) versus Rynex/water (95:5):

$$\%\text{ improvement}=abs[(42.4-38.3)]/(48.9-38.3)\times 100=-39\%$$

For DMM/water (96:4) versus EcoSolv™ DCF:

$$\%\text{ improvement}=abs[(42.4-43.4)]/(48.9-43.4)\times 100=+18\%$$

TABLE 1

Total Color Removal Results

| Cleaner | Final APHA color of cleaner |
|---|---|
| Water | 160 |
| PERC | 111 |
| DMM/water (96:4) | 92 |
| EcoSolv DCF | 70 |
| Rynex/water (90:10) | 54 |

TABLE 2

Shrinkage Results

| Cleaner | % shrinkage, length | % shrinkage, width |
|---|---|---|
| DMM | 0 | 0 |
| DMM/water (96:4) | 0.25 | 1.50 |
| Rynex/water (90:10) | 2.85 | 2.71 |

TABLE 3

Stain Index Results

| CLEANER | Oil | Butter | Clay | Baby Food | Tea | β-Carotene | Grass | Red Dye/ Animal Fat |
|---|---|---|---|---|---|---|---|---|
| Control | 53.2 | 37.8 | 35.0 | 25.7 | 49.6 | 5.8 | 29.4 | 85.5 |
| DMM/water (96:4) | 33.5 | 8.9 | 33.8 | 29.1 | 51.7 | 5.8 | 29.5 | 6.7 |
| Rynex[1]/water (95:5) | 48.5 | 14.1 | 34.4 | 25.5 | 43.2 | 8.3 | 14.2 | 13.5 |
| Rynex/water (90:10) | 51.3 | 11.9 | 34.9 | 25.8 | 42.6 | 5.8 | 31.4 | 26.3 |
| Water | 62.7 | 26.4 | 37.0 | 31.6 | 37.2 | 16.2 | 31.4 | 68.4 |
| PERC | 25.9 | 11.7 | 39.2 | 34.4 | 53.9 | 12.4 | 42.5 | 14.7 |
| EcoSolv DCF[2] | 36.0 | 11.8 | 40.1 | 33.7 | 52.8 | 5.6 | 41.2 | 13.5 |
| DMM/water RANK--> | 2 | 1 | 1 | 4 | 5 | 2 | 3 | 1 |

| CLEANER | Spaghetti Sauce | Blood | Dessert | Peat | Red Wine | Curry | Make-up | Whiteness Index |
|---|---|---|---|---|---|---|---|---|
| Control | 39.0 | 69.4 | 69.8 | 39.3 | 46.5 | 68.3 | 78.9 | 102 |
| DMM/water (96:4) | 41.9 | 83.8 | 94.9 | 44.4 | 48.4 | 51.8 | 71.7 | 82.8 |
| Rynex/water (95:5) | 35.3 | 63.6 | 70.8 | 44.0 | 42.3 | 60.2 | 56.7 | 99.3 |
| Rynex/water (90:10) | 31.4 | 63.3 | 75.3 | 39.2 | 47.1 | 57.4 | 66.4 | 89.8 |
| Water | 23.3 | 44.0 | 60.9 | 38.8 | 41.3 | 61.9 | 58.9 | 81.5 |
| PERC | 40.5 | 69.6 | 74.9 | 42.4 | 54.2 | 66.1 | 66.9 | 64.4 |
| EcoSolv DCF | 39.5 | 71.2 | 73.1 | 40.3 | 58.3 | 66.5 | 67.0 | 94.3 |
| DMM/water RANK--> | 7 | 7 | 7 | 7 | 5 | 1 | 6 | 5 |

[1]Rynex fluid is a DPTB-based cleaner commercially available from Rynex Holdings.

[2]EcoSolv DCF is a hydrocarbon-based cleaner commercially available from CPChem.

TABLE A

Measured L* values

| CLEANER | Oil | Butter | Clay | Baby Food | Tea | β-Carotene | Grass | Red Dye/ Animal Fat |
|---|---|---|---|---|---|---|---|---|
| Control | 52.1 | 83.0 | 79.8 | 87.9 | 78.6 | 95.5 | 87.3 | 64.5 |
| DMM/water (96:4) | 73.5 | 94.0 | 82.4 | 88.2 | 78.6 | 94.6 | 87.9 | 94.7 |
| Rynex/water (95:5) | 56.0 | 92.0 | 80.0 | 88.3 | 82.7 | 92.9 | 92.1 | 92.8 |
| Rynex/water (90:10) | 52.6 | 92.8 | 78.3 | 87.5 | 81.8 | 95.0 | 87.2 | 87.7 |
| Water | 46.0 | 86.7 | 77.0 | 83.5 | 80.5 | 90.4 | 83.9 | 70.8 |
| PERC | 77.7 | 90.9 | 74.2 | 82.2 | 73.7 | 89.5 | 77.3 | 88.6 |
| EcoSolv DCF | 68.0 | 92.4 | 74.7 | 84.7 | 76.7 | 94.4 | 81.7 | 90.9 |

| CLEANER | Spaghetti Sauce | Blood | Dessert | Peat | Red Wine | Curry | Make-up | No Stain |
|---|---|---|---|---|---|---|---|---|
| Control | 83.1 | 45.5 | 55.8 | 72.9 | 76.8 | 75.0 | 52.4 | 95.7 |
| DMM/water (96:4) | 83.8 | 40.6 | 46.3 | 70.2 | 78.4 | 79.0 | 60.6 | 93.7 |
| Rynex/water (95:5) | 85.1 | 48.7 | 55.1 | 70.7 | 80.7 | 76.9 | 69.4 | 95.3 |
| Rynex/water (90:10) | 86.5 | 48.8 | 51.4 | 73.2 | 80.2 | 75.5 | 62.1 | 94.5 |
| Water | 88.5 | 72.0 | 58.7 | 73.8 | 78.0 | 73.2 | 66.1 | 94.0 |
| PERC | 77.7 | 44.1 | 49.4 | 69.6 | 71.9 | 69.1 | 59.1 | 83.0 |
| EcoSolv DCF | 82.3 | 43.2 | 52.6 | 72.3 | 74.4 | 72.2 | 61.9 | 94.4 |

TABLE B

Measured a* values

| CLEANER | Oil | Butter | Clay | Baby Food | Tea | β-Carotene | Grass | Red Dye/ Animal Fat |
|---|---|---|---|---|---|---|---|---|
| Control | 0.084 | 3.79 | 2.26 | 3.12 | 6.72 | −0.47 | −3.41 | 38.9 |
| DMM/water (96:4) | 1.74 | 0.09 | 2.61 | 3.58 | 6.70 | 0.12 | 0.63 | 0.35 |
| Rynex/water (95:5) | 0.92 | 1.31 | 2.29 | 2.95 | 4.73 | 0.69 | −0.35 | 5.13 |
| Rynex/water (90:10) | 1.02 | 0.63 | 2.18 | 3.61 | 5.15 | −0.02 | 0.65 | 11.0 |
| Water | 2.02 | 1.30 | 2.41 | 3.84 | 4.12 | 0.03 | 0.37 | 29.4 |
| PERC | 1.07 | −0.11 | 2.16 | 4.53 | 6.72 | 0.65 | −0.45 | 1.38 |
| EcoSolv DCF | 1.13 | 0.25 | 2.39 | 5.22 | 7.50 | 0.0 | −0.85 | 2.81 |

TABLE B-continued

| Measured a* values | | | | | | | | |
|---|---|---|---|---|---|---|---|---|
| CLEANER | Spaghetti Sauce | Blood | Dessert | Peat | Red Wine | Curry | Make-up | No Stain |
| Control | 3.55 | 6.83 | 11.3 | 3.18 | 11.3 | 6.21 | 11.8 | 0.09 |
| DMM/water (96:4) | 3.40 | 8.14 | 16.1 | 3.75 | 9.75 | 3.23 | 9.93 | 0.41 |
| Rynex/water (95:5) | 2.81 | 3.28 | 11.2 | 3.77 | 8.92 | 3.84 | 7.44 | 0.28 |
| Rynex/water (90:10) | 2.82 | 2.80 | 11.6 | 3.22 | 10.8 | 5.30 | 9.63 | 0.21 |
| Water | 1.17 | 1.45 | 8.60 | 3.14 | 7.83 | 4.20 | 8.93 | 0.14 |
| PERC | 2.72 | 4.44 | 10.5 | 3.00 | 11.0 | 4.68 | 8.68 | 1.04 |
| EcoSolv DCF | 3.67 | 4.95 | 11.2 | 3.21 | 14.6 | 5.79 | 9.76 | 0.16 |

TABLE C

| Measured b* values | | | | | | | | |
|---|---|---|---|---|---|---|---|---|
| CLEANER | Oil | Butter | Clay | Baby Food | Tea | β-Carotene | Grass | Red Dye/ Animal Fat |
| Control | 5.22 | 17.1 | 12.5 | 10.5 | 21.5 | 0.81 | 13.2 | 11.1 |
| DMM/water (96:4) | 5.33 | 2.81 | 13.6 | 13.7 | 23.6 | 0.30 | 16.7 | 1.06 |
| Rynex/water (95:5) | 3.58 | 4.71 | 12.1 | 10.8 | 21.2 | 0.47 | 5.94 | −1.11 |
| Rynex/water (90:10) | 2.90 | 4.03 | 11.0 | 9.67 | 19.2 | −0.80 | 18.0 | 2.91 |
| Water | 6.62 | 11.8 | 11.6 | 11.2 | 13.6 | 6.64 | 15.0 | 9.71 |
| PERC | 2.57 | 2.50 | 11.3 | 12.1 | 20.8 | 1.23 | 19.4 | 1.89 |
| EcoSolv DCF | 2.88 | 3.93 | 12.4 | 13.2 | 22.1 | −0.04 | 22.0 | 1.50 |
| CLEANER | Spaghetti Sauce | Blood | Dessert | Peat | Red Wine | Curry | Make-up | No Stain |
| Control | 18.5 | 8.06 | 14.3 | 9.03 | 12.0 | 37.2 | 19.5 | −1.91 |
| DMM/water (96:4) | 22.3 | 16.3 | 25.1 | 10.9 | 17.0 | 27.5 | 22.4 | 0.94 |
| Rynex/water (95:5) | 17.6 | 9.07 | 14.6 | 10.9 | 14.0 | 33.3 | 18.6 | −1.56 |
| Rynex/water (90:10) | 15.1 | 9.25 | 15.1 | 9.18 | 16.6 | 27.5 | 18.8 | −0.08 |
| Water | 10.6 | 14.5 | 11.0 | 9.41 | 11.5 | 30.9 | 16.0 | 1.30 |
| PERC | 15.5 | 9.17 | 13.8 | 9.07 | 15.0 | 30.5 | 17.3 | 0.96 |
| EcoSolv DCF | 18.1 | 9.46 | 14.5 | 9.36 | 18.1 | 33.0 | 19.1 | −0.98 |

TABLE 4

| Stain Index: Average Composite Values, Relative Rank, and % Improvement from DMM | | | |
|---|---|---|---|
| Cleaner | Ave. Stain Index | Rank | DMM's % Improvement |
| control | 48.9 | — | — |
| Rynex/water (95:5) | 38.3 | 1 | −39% |
| Rynex/water (90:10) | 40.7 | 2 | −21% |
| DMM/water (96:4) | 42.4 | 3 | — |
| Water | 42.7 | 4 | +4.8% |
| PERC | 43.3 | 5 | +16% |
| EcoSolv DCF | 43.4 | 6 | +18% |

TABLE 5

| Evaporation Rate Comparison[1] | | |
|---|---|---|
| Cleaner | Relative Rate vs. n-butyl acetate (=1) | Relative Rate vs. Rynex (=1) |
| Rynex | 0.012 | — |
| EcoSolv DCF | 0.060 | 5.0 |
| DMM | 0.11 | 9.2 |

[1]Measured using a Falex evaporometer and ASTM D-3539.

TABLE 6

| Water Solubility | | |
|---|---|---|
| Cleaner | % solubility of water in the cleaner | % solubility of the cleaner in water |
| Rynex | 9.9 | <5 |
| EcoSolv DCF | 0.011 | <1 |
| DMM | 4.5 | 35 |

TABLE 7

| Water/Cleaner Separation (1:1 mixtures) | | | |
|---|---|---|---|
| Cleaner | Time to Form Two Distinct Layers = $T_1$ (s) | Separation Quality at $T_1$ | Separation Quality at T = 1 h |
| Rynex | 110 | Both layers cloudy | Both layers cloudy |
| EcoSolv DCF | 10 | Cloudy water phase | Clear, distinct layers |
| DMM | 22 | Clear, distinct layers | Clear, distinct layers |

The preceding examples are meant only as illustrations. The following claims define the invention.

We claim:

1. A method which comprises drycleaning a fabric or fiber using a composition comprising at least about 4 wt. % to about 10 wt. % water and at least 90 wt. % of dipropylene glycol dimethyl ether (DMM).

2. The method of claim 1 wherein the composition comprises at least about 95 wt. % of DMM.

3. The method of claim 1 wherein the composition comprises about 5 wt. % of water.

4. The method of claim 1 wherein the composition consists essentially of DMM and water.

5. The method of claim 4 wherein the composition comprises at least about 95 wt. % of DMM and about 5 wt. % of water.

6. The method of claim 1 wherein the fabric is a garment.

7. The method of claim 1 wherein the fiber is wool fiber.

8. A method which comprises drycleaning a fabric using a composition comprising at least about 4 wt. % to about 5 wt. % water and at least 95 wt. % of DMM.

9. The method of claim 8 wherein the composition comprises about 5 wt. % of water.

10. The method of claim 8 wherein the fabric is a garment.

11. A method which comprises:

(a) tumbling garments in the presence of a cleaning composition comprising at least about 4 wt. % to about 10 wt. % water and at least 90 wt. % of DMM;

(b) separating the garments from the cleaning composition; and (c) tumbling the garments in heated air to remove traces of the cleaning composition from the garments.

12. The method of claim 11 wherein the cleaning composition comprises at least about 95 wt. % of DMM.

13. The method of claim 11 wherein the cleaning composition comprises up to about 5 wt. % of water.

14. The method of claim 11 wherein the cleaning composition is reused after purifying it by adsorption, distillation, or a combination of these methods.

* * * * *